US011148306B2

(12) United States Patent
Yagyu

(10) Patent No.: US 11,148,306 B2
(45) Date of Patent: Oct. 19, 2021

(54) HAIRDRESSING SCISSORS

(71) Applicant: YAGYU CO., LTD., Hiroshima (JP)

(72) Inventor: Matsuo Yagyu, Hiroshima (JP)

(73) Assignee: YAGYU CO., LTD., Hiroshima (JP)

( * ) Notice: Subject to any disclaimer, the term of this patent is extended or adjusted under 35 U.S.C. 154(b) by 0 days.

(21) Appl. No.: 16/709,855

(22) Filed: Dec. 10, 2019

(65) Prior Publication Data

US 2020/0130204 A1 Apr. 30, 2020

Related U.S. Application Data

(63) Continuation of application No. PCT/JP2019/004666, filed on Feb. 8, 2019.

(30) Foreign Application Priority Data

Feb. 20, 2018 (JP) ..... JP2018-027606

(51) Int. Cl.
*B26B 13/20* (2006.01)
*B26B 13/28* (2006.01)

(52) U.S. Cl.
CPC ..... *B26B 13/20* (2013.01); *B26B 13/28* (2013.01)

(58) Field of Classification Search
CPC ..... B26B 13/20; B26B 13/28
See application file for complete search history.

(56) References Cited

U.S. PATENT DOCUMENTS 3,840,990 A * 10/1974 Laurenti ..... B21D 53/642 30/341
6,272,754 B1 * 8/2001 Hesprich ..... B26B 13/20 30/232
2009/0095429 A1 4/2009 Bland
2016/0368156 A1 * 12/2016 Albano ..... B26B 13/28

FOREIGN PATENT DOCUMENTS

CN 202225226 U 5/2012
CN 106493756 A 3/2017
EP 1323504 A1 4/2002
(Continued)

OTHER PUBLICATIONS

Office Action in Japanese Application No. 2020-501680, dated Jun. 2, 2020.
(Continued)

*Primary Examiner* — Omar Flores Sanchez
(74) *Attorney, Agent, or Firm* — DLA Piper LLP (US)

(57) ABSTRACT

Hairdressing scissors include a pair of blade bodies each having a blade portion, a middle portion, and a handle portion in turn from a tip side. The handle portion includes first and second press-formed bodies each in the shape of a flat plate and facing each other along an axial center of a pivot to extend parallel to each other along a longitudinal direction of the blade body; and cylindrical collars and first and second resin materials configured to bridge the first and second press-formed bodies. The first press-formed body includes an extension portion extending toward an associated middle portion further than the second press-formed body to be connected to the associated middle portion, and the second press-formed body is spaced apart from the associated middle portion.

16 Claims, 12 Drawing Sheets

(56) References Cited

FOREIGN PATENT DOCUMENTS

| | | | |
|---|---|---|---|
| GB | 1 487 192 | A | 9/1977 |
| JP | 50-110491 | U | 9/1975 |
| JP | 2-119162 | U | 9/1990 |
| JP | 2003-38869 | A | 2/2003 |
| JP | 2013-13382 | | 1/2013 |
| JP | 2017-51609 | A | 3/2017 |
| WO | WO 02/30632 | A1 | 4/2002 |
| WO | WO2006/022368 | | 3/2006 |

OTHER PUBLICATIONS

Extended European Search Report in European Application No. 19757143.3, dated Feb. 12, 2021.
Office Action in Chinese Application No. 201980007895.2, dated May 24, 2021.
International Search Report in International Application No. PCT/JP2019/004666 dated Apr. 23, 2019.

* cited by examiner

HAIRDRESSING SCISSORS

CROSS-REFERENCE TO RELATED APPLICATION

This application is a Continuation of International Application No. PCT/JP2019/004666 filed on Feb. 8, 2019, which claims the benefit of Japanese Patent Application No. 2018-027606, filed on Feb. 20, 2019, each of which is incorporated herein by reference in its entirety and for all purposes.

TECHNICAL FIELD

The present disclosure relates to hairdressing scissors for use in hairdressing.

BACKGROUND OF DISCLOSURE

Traditionally, for example, hairdressing scissors disclosed in International Publication WO2006/022368 include a pair of blade bodies each formed of a blade portion, a middle portion, and a handle portion in turn from the tip side; and a pivot inserted in turn into axial support holes each formed in the middle portion of the respective blade bodies to thereby rotatably connect the blade bodies to one another. The hairdressing scissors are configured to have the handle portions closer to and away from each other to thereby close and open the blade portions. The handle portion then has a portion that includes a hollow section enclosing a viscoelastic material to reduce weight, resulting in reduction of a load required for a user to use.

SUMMARY

In this regard, the hairdressing scissors as described in International Publication WO2006/022368 include the middle portions and the handle portions of the blade bodies that are often formed by casting. A mirror finish is generally applied on surfaces of the middle portions and the handle portions by highly skilled workers to improve the design.

The mirror finish, however, requires highly skilled techniques. In recent years where highly skilled workers are decreasing in number, the issue that more workloads cause increased production cost is emerging.

The present disclosure is made in view of the foregoing and an object of the present disclosure is to provide hairdressing scissors that are lightweight to enable reduction of the load required for a user to use, as well as that are inexpensive and have improved design.

To achieve the object, the present disclosure is characterized by adopting as a part of a structure of each handle portion a pair of plate parts formed from a metal plate or resin member and facing each other to extend parallel to each other.

Specifically, the present disclosure is directed to hairdressing scissors including a pair of blade bodies each formed of a blade portion, a middle portion, and a handle portion in turn from a tip side; and a pivot inserted in turn into axial support holes each formed in the middle portion of the respective blade bodies, and configured to rotatably connect the blade bodies to each other to have the handle portions closer to and away from each other to close and open the blade portions. The following solutions are then applied.

According to a first aspect of the present disclosure, the handle portion includes first and second plate parts formed from a flat metal plate or resin member and facing each other along an axial center of the pivot to extend parallel to each other along a longitudinal direction of the blade body, and one or more bridges configured to bridge the first and second plate parts, wherein the first plate part includes an extension portion extending toward an associated middle portion further than the second plate part to be connected to the associated middle portion, and the second plate part is spaced apart from the associated middle portion, and the first and second plate parts of one of the handle portions are positioned on one and the other end sides of the pivot respectively, and the first and second plate parts of the other of the handle portions are positioned on the other and the one end sides of the pivot respectively.

According to a second aspect of the present disclosure which is an embodiment of the first aspect, the first plate part includes a first ring through which a user's finger can be inserted, and the second plate part includes, at a position of the second plate part facing the first ring, a second ring through which a user's finger can be inserted, and a plurality of openings each having a varying shape are formed in areas of the first plate part excluding the first ring and of the second plate part excluding the second ring.

According to a third aspect of the present disclosure which is an embodiment of the second aspect, one of the first and second rings facing each other is a thumb base side ring positioned on a base side of a thumb with the thumb being inserted for hairdressing, the other of the first and second rings facing each other is a thumb tip side ring positioned on a tip side of the thumb with the thumb being inserted for hairdressing, and a portion of the thumb base side ring opposite the middle portion includes a cutout section that is cut out to have inner and outer areas of the thumb base side ring in communication with each other, and the cutout section is formed to have a width size larger than a width size of the thumb.

According to a fourth aspect of the present disclosure which is an embodiment of the second and third aspects, one of the first and second rings facing each other is formed to have a size larger than the other of the first and second rings facing each other.

According to a fifth aspect of the present disclosure which is an embodiment of the fourth aspect, one of the first and second rings facing each other is formed to have a size wider than the other of the first and second rings facing each other, in a direction along the longitudinal direction of the blade body.

According to a sixth aspect of the present disclosure which is an embodiment of any one of the one to fifth aspects, one of the extension portions is provided in a handle portion associated with a thumb during hairdressing and bent in a direction away from a user's palm holding the scissors to have a cross-section that is an obtusely angled V-shape.

According to a seventh aspect of the present disclosure which is an embodiment of any one of the first to sixth aspects, at least one of the bridges is a resin material filling part of a space between the first and second plate parts.

According to an eighth aspect of the present disclosure which is an embodiment of the seventh aspect, the resin material includes a pair of resin materials provided along edges of the respective handle portions on sides of the handle portions that come closer to each other, and one of the resin materials includes a contact extending toward the other of the resin materials and configured to come in contact with the other of the resin materials to regulate subsequent rotation of the blade bodies when the handle portions are brought closer to close the blade portions.

According to a ninth aspect of the present disclosure which is an embodiment of any one of the one to seventh aspects, one of the middle portions includes on a handle portion side thereof a projection extending along the axial center of the pivot and configured to contact an edge of the handle portion side of the other of the middle portions to regulate subsequent rotation of the blade bodies when the handle portions are brought closer to close the blade portions.

According to a tenth aspect of the present disclosure which is an embodiment of any one of the one to ninth aspects, the extension portion is fastened to the associated middle portion by using a fastening member positioned to extend along the axial center of the pivot.

According to an eleventh aspect of the present disclosure which is an embodiment of any one of the first to tenth aspects, at least one of the bridges includes a size adjusting part configured to be able to change a size of the associated handle portion in a thickness direction of the handle portion.

According to a twelfth aspect of the present disclosure which is an embodiment of any one of the first to eleventh aspects, one of the handle portions corresponds with a thumb of a user during hairdressing, and all of the bridges in the other of the handle portions are formed to have a size larger than that of all of the bridges in the one of the handle portions in the thickness direction of the handle portion.

According to a thirteenth aspect of the present disclosure which is an embodiment of any one of the first to twelfth aspects, the handle portion includes a third plate part formed from a flat metal plate or resin member and disposed on a front surface side of the associated first or second plate part at a predetermined spacing to extend parallel to the first or second plate part; and one or more connectors configured to connect the first and third plate parts or the second and third plate parts.

According to a fourteenth aspect of the present disclosure which is an embodiment of the thirteenth aspect, the third plate part includes, at a position corresponding to the first or second ring, a third ring through which a user's finger can be inserted, and the connector is a flexible ring body configured to allow a user's finger to be inserted and capable of fitting with the first and third rings or the second and third rings.

According to a fifteenth aspect of the present disclosure which is an embodiment of the thirteenth or fourteenth aspect, the third plate part includes a curved recess that opens at a back surface side, the first or second plate part includes, at a position corresponding to the curved recess, a protrusion capable of fitting loosely into the curved recess.

According to a sixteenth aspect of the present disclosure which is an embodiment of any one of the one to fifteenth aspects, the second plate part includes on a middle portion side thereof a bend that is bent toward the first plate part.

According to the first aspect of the present disclosure, when the scissors are assembled, a portion between the first and second plate parts of each of the handle portions except the bridges renders a space without structures. The scissors are then lightweight on a handle portion side thereof and thus can reduce a load required for a user to move the handle portions during hairdressing. Components forming front and back surfaces of the handle portion are then formed from a metal plate or resin member. As a result, the surfaces of the handle portion do not need a mirror finish, or even when a mirror finish is applied to the surfaces of the handle portion, less labor is required as compared to commonly used hairdressing scissors having handle portions formed by casting. Accordingly, a workload of worker for manufacturing the scissors can be reduced, enabling the scissors to be inexpensive. Then, one of the extension portions is connected to the middle portion of one of the blade bodies on one end side of the pivot and the other of the extension portions is connected to the middle portion of the other of the blade bodies on the other end side of the pivot. Moreover, both of the second plate parts are not connected to the respective middle portions. Thus, the scissors are configured to avoid the state where each of the second plate parts contacts the mating blade body to make the scissors unable to close when the handle portions of the assembled scissors are brought closer to each other.

According to the second aspect of the present disclosure, each of the handle portions has an appearance as if formed by combining a plurality of frames, and thereby, design of the whole scissors can be improved.

According to the third aspect of the present disclosure, the thumb can be fit into the cutout section, for example, when the user holds the scissors in a state where the user orients an index finger toward the tips of the scissors to place the finger on the associated middle portion of the scissors and places the thumb to be angled with respect to the first and second rings. Thus, even when the user holds the scissors in the particular state as described above, the user can firmly engage the thumb with the handle portion without a load on the thumb so as to perform close and open operations of the scissors.

According to the fourth aspect of the present disclosure, when the user performs hairdressing, the user can easily rotate the thumb with respect to the blade body within a range of one of the first and second rings about the other of the first and second rings as a rotation supporting point. The user thus can easily change a position of the scissors in accordance with preference of the user during hairdressing.

According to the fifth aspect of the present disclosure, when the user performs hairdressing, particularly, when the user swings the thumb along the longitudinal direction of the blade body to change a position of a hand with respect to the scissors, the user can easily change a state of the scissors, enabling efficient hairdressing.

According to the sixth aspect of the present disclosure, the thumb has an extension direction oriented parallel to a penetrating direction of the first and second rings, for example, when the user holds the scissors in a state where the user orients the index finger toward the tips of the scissors to place the finger on the associated middle portion of the scissors and places the thumb to be angled with respect to the first and second rings. This enables less load applied from the first and second rings onto the thumb. Even when the user holds the scissors in the particular state as described above, the user thus can firmly engage the thumb with the handle portion to easily perform close and open operations of the scissors.

According to the seventh aspect of the present disclosure, the resin material is visible between the first and second plate parts and adds a change in the design of the handle portions, thus further improving the design of the scissors.

According to the eighth aspect of the present disclosure, the handle portions have mutually contacting portions formed of a resin, so that when the handle portions are brought closer to each other, impact of the contacting can be efficiently absorbed.

According to the ninth aspect of the present disclosure, the rotation of the blade bodies stops at a predetermined position when the handle portions are brought closer to each other. This allows the scissors to have required functions even with scissors having no resin material between the first and second plate parts as described in the eighth aspect.

According to the tenth aspect of the present disclosure, when the extension portion is fastened to the middle portion, an angle of the extension portion around the fastening member with respect to the middle portion can be finely adjusted. Thus, a change of a fine angle between the middle portion and the handle portion in the scissors can be performed in accordance with preference of the user.

According to the eleventh aspect of the present disclosure, the size of each of the handle portions in the thickness direction can be changed in accordance with preference of the user, enabling the hairdressing scissors to have significant advantages for ease of use by the user.

According to the twelfth aspect of the present disclosure, when the user places index and middle fingers on an outer peripheral edge of the corresponding handle portion, the first and second plate parts are spaced apart in a direction of finger extension to contact with the fingers. This allows the user to perform stable close and open operations of the scissors during hairdressing, enabling the hairdressing scissors to have further significant advantages for ease of use by the user.

According to the thirteenth embodiment of the present disclosure, when fingers are placed on the outer peripheral edge of the corresponding handle portion for operating the hairdressing scissors, the fingers are supported by the three plate parts arranged side-by-side at the predetermined spacing, and firmly engage with each plate part along the thickness direction of the handle portion. Thus, the fingers are less likely to slip along the thickness direction of the handle portion to ease the holding of the hairdressing scissors, enabling improved operability of the hairdressing scissors. The hairdressing scissors then has a weight distribution in which a handle portion side is heavier than a blade portion side. The center of gravity of the hairdressing scissors is thus positioned on a user's hand side. This allows the blade portion side to be lighter, resulting in further improved operability of the hairdressing scissors.

According to the fourteenth embodiment of the present disclosure, when the hairdressing scissors are used, fingers are inserted into the flexible ring body. An improved tactile property of the handle portion is thus provided for the fingers during operation of the hairdressing scissors. The ring body is flexible to be easily connected to the respective rings and to also be able to establish an intimate contact with the respective rings. In addition, the third plate part freely moves in a tilting manner with respect to the first or second plate part about the flexible ring body as a supporting point. The third plate part thus tilts to correspond to movement of a user's hand during operations of the hairdressing scissors, enabling the hairdressing scissors to have excellent operability.

According to the fifteenth embodiment of the present disclosure, when the third plate part is attached to the first or second plate part using the ring body, the protrusion is inserted to the curved recess, so that the third plate part is prevented from significantly rotating with respect to the first or second plate part circumferentially about a centerline of the ring body even when unexpected force circumferential about the centerline of the ring body is applied to the third plate part.

According to the sixteenth embodiment of the present disclosure, when the user uses the hairdressing scissors, the fingers of the user are less likely to collide with an end portion of a first plate part side of the second plate part, thus enabling further improved operability of the hairdressing scissors.

DESCRIPTION OF EMBODIMENTS

Embodiments of the present disclosure will now be described in detail with reference to the drawings. It is noted that the following description of preferred embodiments is merely an example in nature.

First Embodiment of Disclosure

Figure 1:
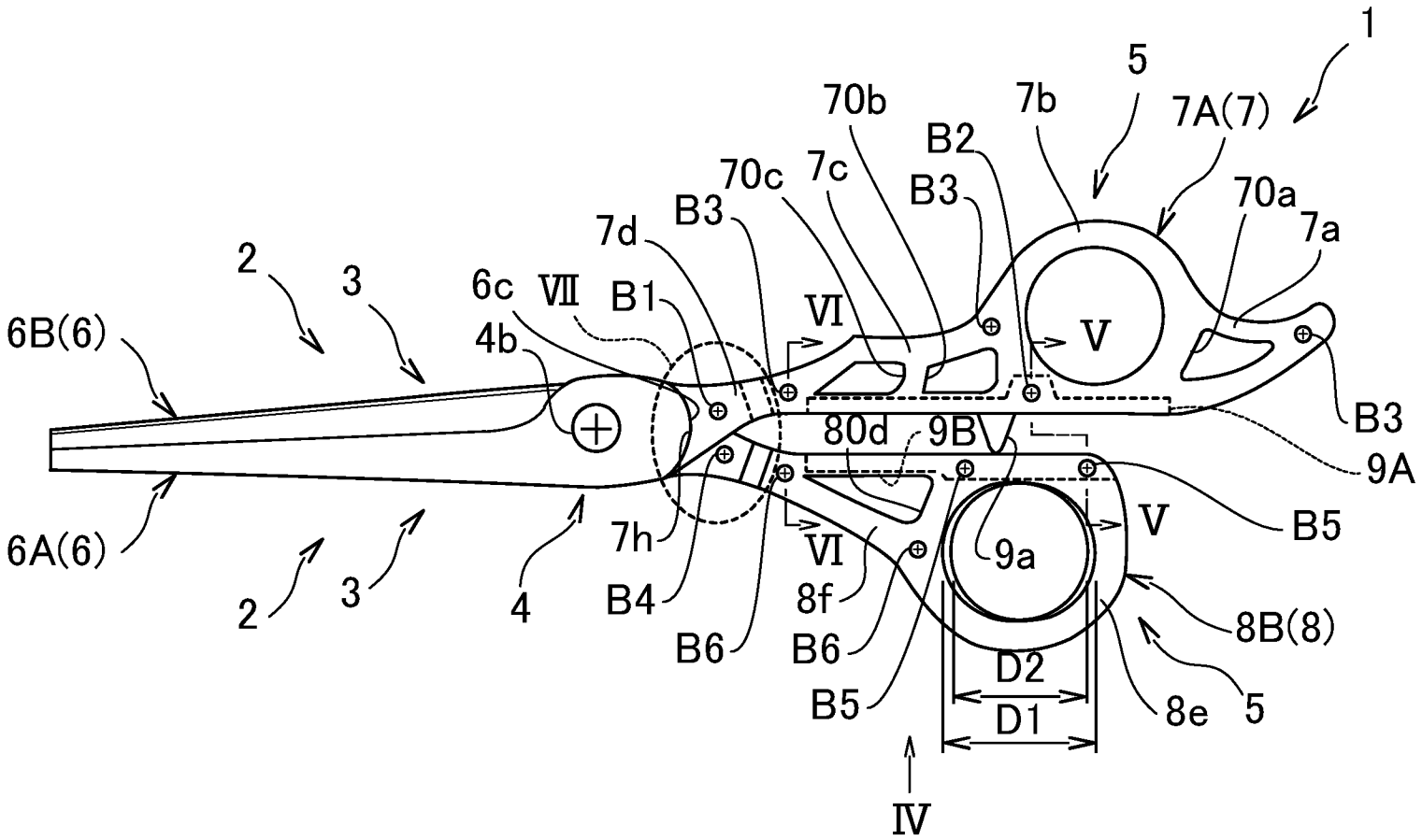
FIG. 1 is a front view illustrating hairdressing scissors according to a first embodiment of the present disclosure.
Figure 2:
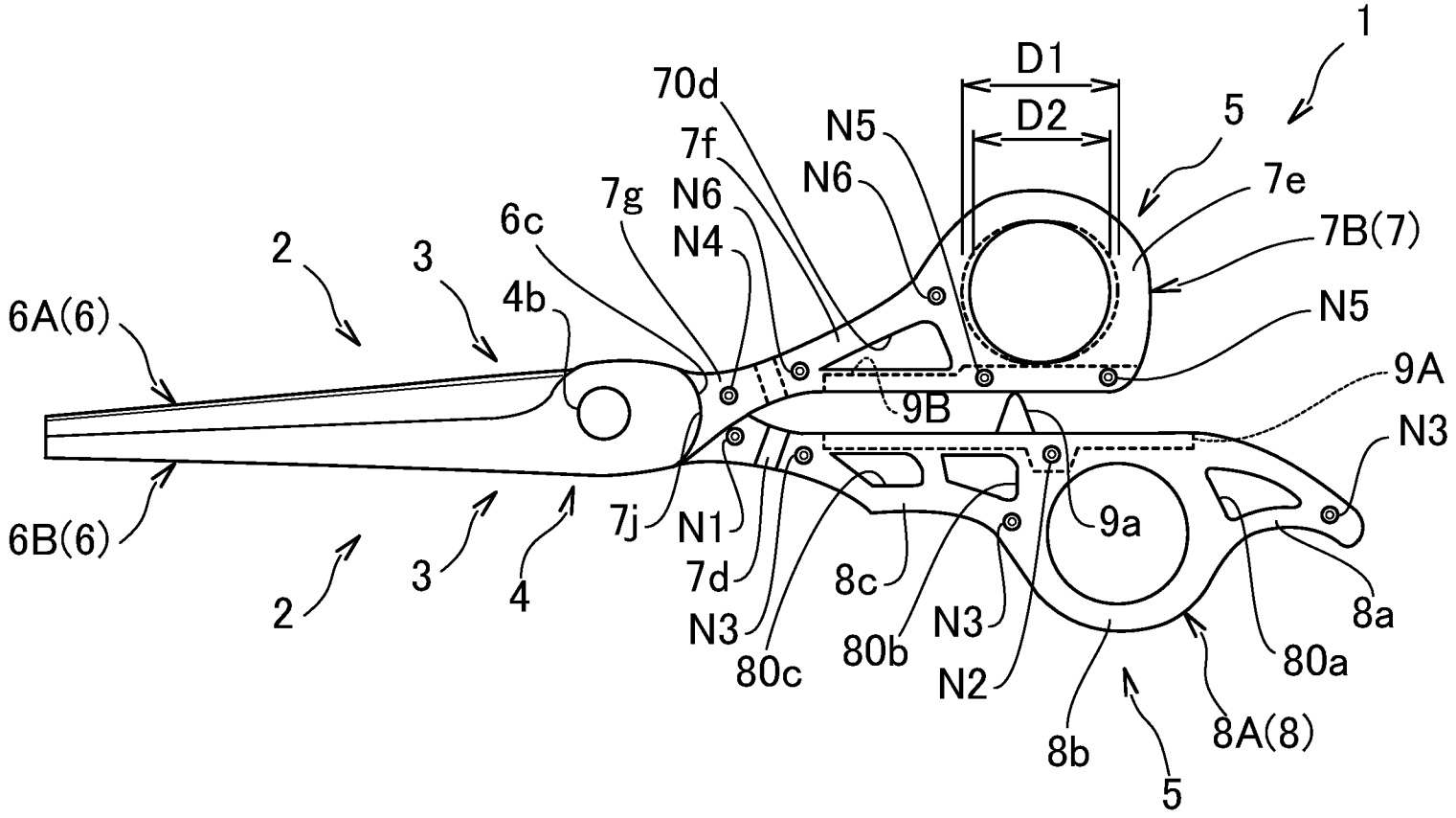
FIG. 2 is a rear view illustrating hairdressing scissors according to the first embodiment of the present disclosure.
Figure 3:
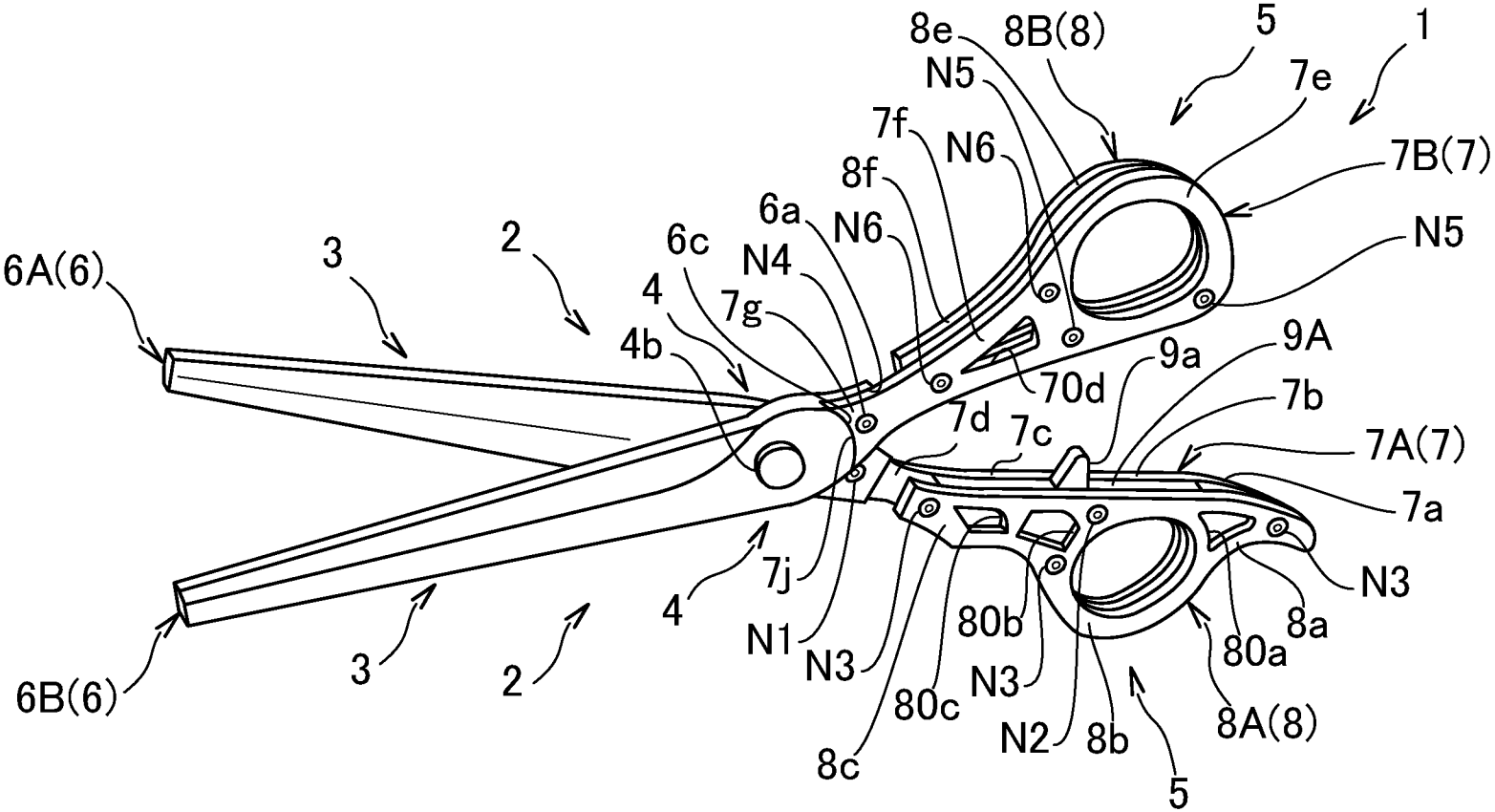
FIG. 3 is a perspective view illustrating hairdressing scissors according to the first embodiment of the present disclosure, as viewed from the rear.

FIGS. 1 to 3 illustrate hairdressing scissors 1 according to a first embodiment of the present disclosure. The hairdressing scissors 1 are used by, for example, hairdressers for hairdressing. The hairdressing scissors 1 include a pair of blade bodies 2 each formed of a blade portion 3, a middle portion 4, and a handle portion 5 in turn from a tip side. The blade bodies 2 are stacked at the middle portions 4 to lie across each other. Axial support holes 4*a* extending through in a stacking direction of the blade bodies 2 are formed in the respective middle portions 4 (see FIG. 4). A pivot 4*b* rotatably connecting the blade bodies 2 to each other is inserted into the axial support holes 4*a* to have the handle portions 5 closer to and away from each other to thereby close and open the blade portions 3.

The blade body 2 includes a cutout member 6 provided on a tip side of the blade body 2 and having a sharp portion of a tip generally triangular in shape as viewed from the front; and a first press-formed body 7 (first plate part) and second press-formed body 8 (second plate part) provided at a base end side of the cutout member 6.

The cutout member 6 is formed by cutting a stainless steel based cutting tool steel material by means of wire electrical discharge machining. The cutout member 6 is equivalent to the blade portion 3 and the middle portion 4.

Figure 4:
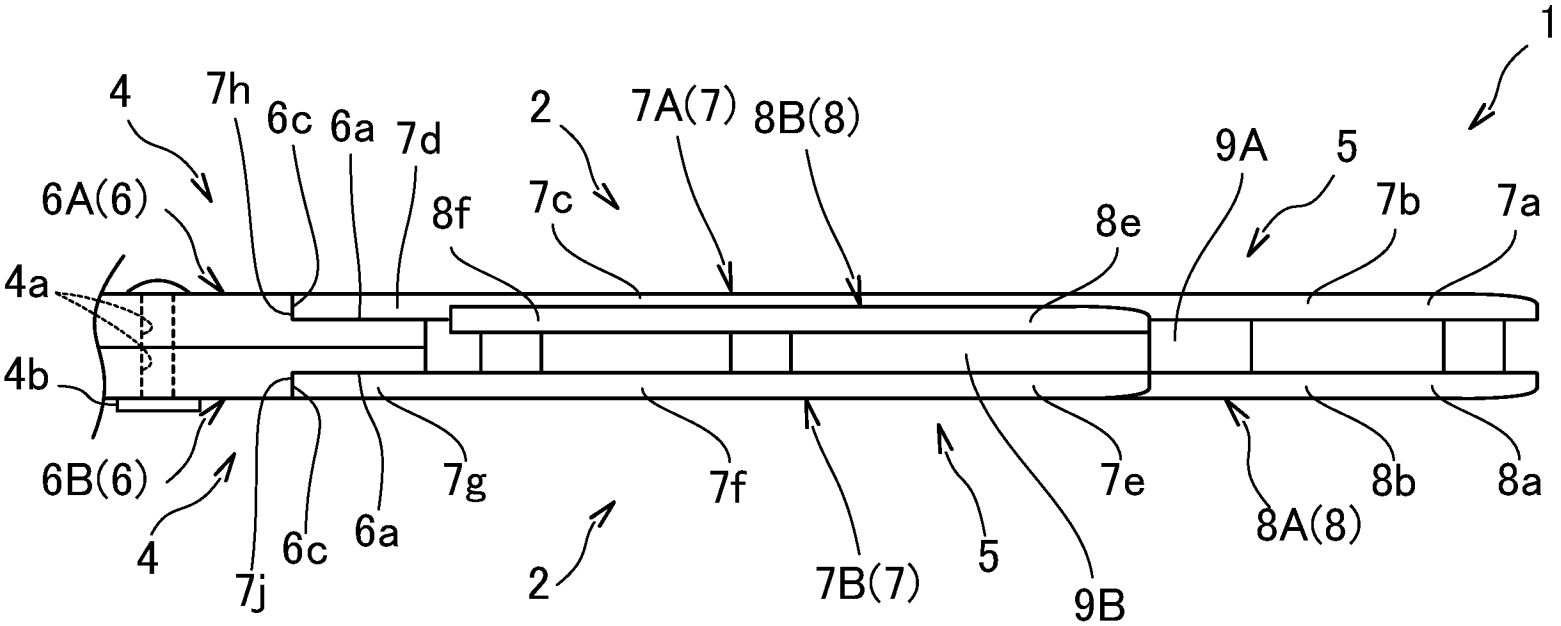
FIG. 4 is a fragmentary view taken in the direction of arrow IV indicated in FIG. 1.

As illustrated in FIG. 4, the cutout member 6 includes an attaching surface portion 6*a* formed on a handle portion 5 side of the cutout member 6 and recessed in a step shape on a front surface side of the cutout member to have generally half a thickness. A screw insertion hole 6*b* is formed generally at a center of the attaching surface portion 6*a* (see FIG. 8).

Figure 7:
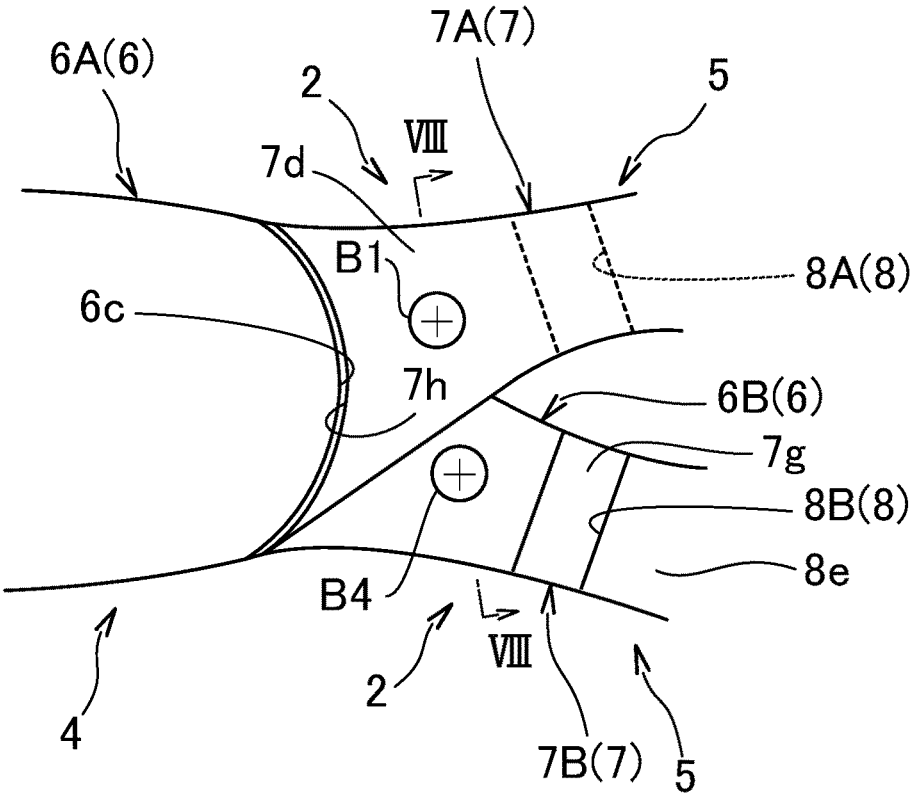
FIG. 7 is an enlarged view of the part VII indicated in FIG. 1.

As illustrated in FIG. 7, the attaching surface portion 6*a* includes a rising wall portion 6*c* gently curved to project toward the handle portion 5.

For reasons of convenience, one of the cutout members is referred to as a cutout member 6A and the other as a cutout member 6B in the following.

The first and second press-formed bodies 7, 8 are then formed by press forming of an aluminum alloy material. The first and second press-formed bodies 7, 8 are equivalent to the handle portion 5 of the present disclosure.

As illustrated in FIGS. 1 to 4, the first and second press-formed bodies 7, 8 are each in the shape of a flat plate and face each other along an axial center of the pivot 4*b* to extend parallel to each other along a longitudinal direction of the blade body 2. For reasons of convenience, first and second press-formed bodies 7, 8 of one of the blade bodies 2 are referred to as first and second press-formed bodies 7A, 8A and first and second press-formed bodies 7, 8 of the other of the blade bodies 2 are referred to as first and second press-formed bodies 7B, 8B, in the following. While the first and second press-formed bodies 7, 8 of the present disclosure are in the shape of a flat plate, the first and second press-formed bodies 7, 8 may be curved to some extent or include a portion having a generally L-shaped cross section in part of an outer peripheral edge thereof.

The first press-formed body 7A is positioned on one end side of the pivot 4*b*. As shown in FIG. 1, the first press-formed body 7A includes a little finger engagement portion 7*a* that has a generally triangular shape as viewed in plan, a ring finger base side ring 7*b* (first ring) into which a user's ring finger can be inserted, a support portion 7*c* that is a portion for placing index and middle fingers on an outer peripheral edge of the support portion to operate, and an extension portion 7*d* extending from the support portion 7*c* toward the associated middle portion 4, in turn from a base end of the blade body 2. The ring finger base side ring 7*b* is shaped to curve and project laterally more than the little finger engagement portion 7*a*, the support portion 7*c*, and the extension portion 7*d*.

An opening 70*a* generally triangular in shape is formed in the little finger engagement portion 7*a*. Openings 70*b*, 70*c* generally trapezoidal in shape are formed side-by-side in the support portion 7*c* along the longitudinal direction of the blade body 2.

Thus, the openings 70*a* to 70*c* each having a varying shape are formed in an area of the first press-formed body 7A excluding the ring finger base side ring 7*b*.

The ring finger base side ring 7*b* is positioned on a base side of a ring finger with the ring finger being inserted for hairdressing.

Figure 5:
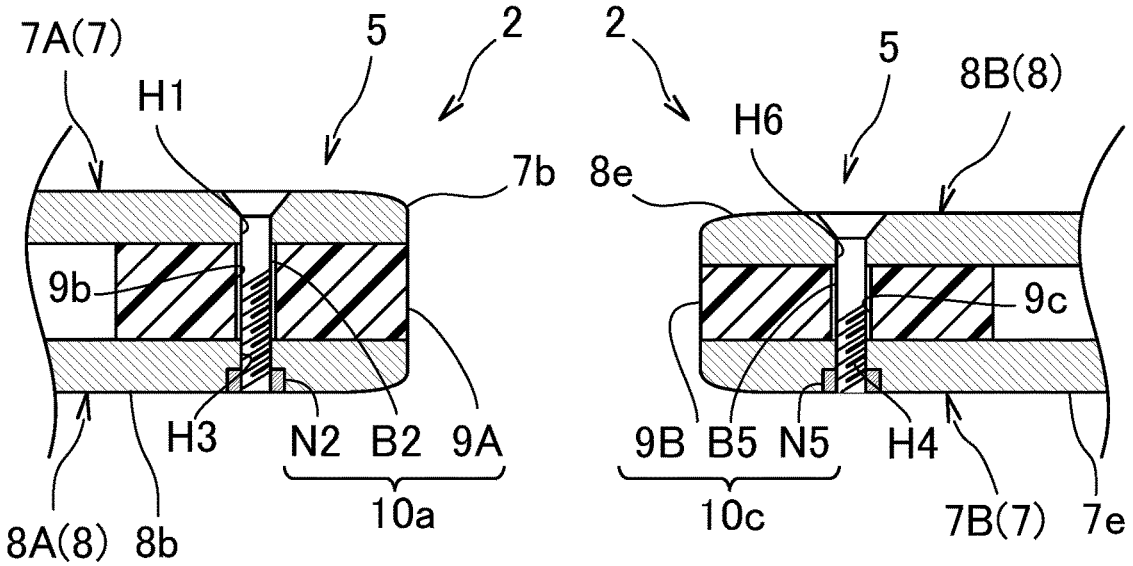
FIG. 5 is a cross-sectional view taken along the plane V-V indicated in FIG. 1.
Figure 6:
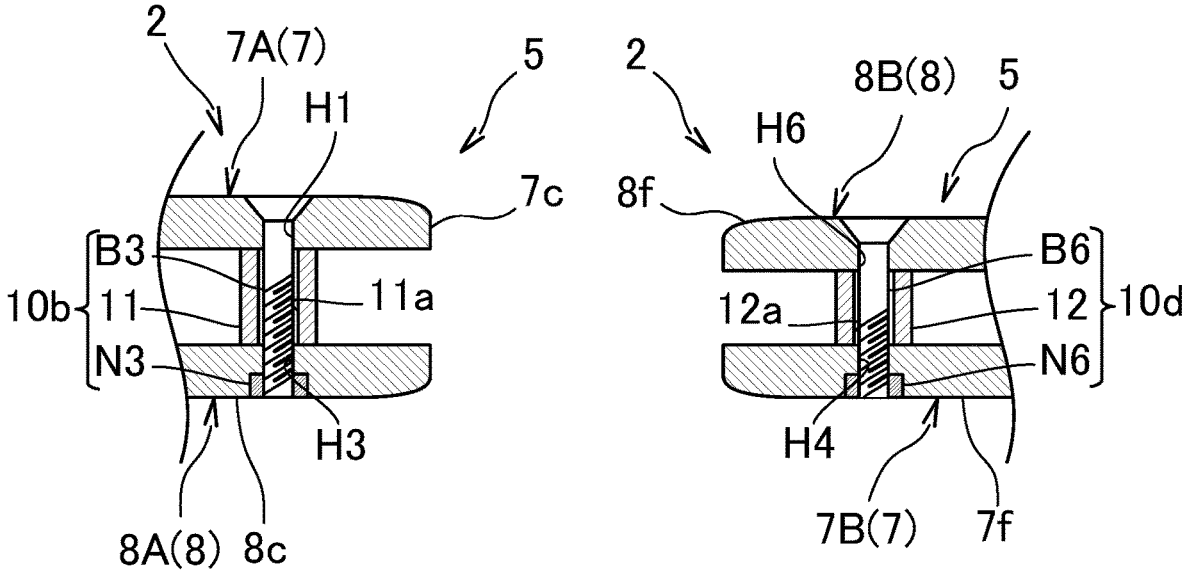
FIG. 6 is a cross-sectional view taken along the plane VI-VI indicated in FIG. 1.

As illustrated in FIGS. 5 and 6, four screw insertion holes H1 are formed in the first press-formed body 7A. Specifically, one of the four screw insertion holes H1 is formed in a portion of the little finger engagement portion 7*a* opposite the ring finger base side ring 7*b*, two of the four screw insertion holes H1 are formed in a continuous portion between the ring finger base side ring 7*b* and the support portion 7*c*, and one of the four screw insertion holes H1 is formed in a continuous portion between the support portion 7*c* and the extension portion 7*d*.

As illustrated in FIG. 4, the extension portion 7*d* includes a portion of a middle portion 4 side of the extension portion 7*d* that can be mounted on the attaching surface portion 6*a* of the cutout member 6A. When the extension portion 7*d* is mounted on the attaching surface portion 6*a*, a surface of the extension portion 7*d* is flush with a surface of the cutout member 6A.

As illustrated in FIG. 7, the extension portion 7*d* includes an edge 7*h* of the middle portion 4 side of the extension portion 7*d* that is concave to gently curve for corresponding to a shape of the rising wall portion 6*c* of the attaching surface portion 6*a* of the cutout member 6A.

Figure 8:
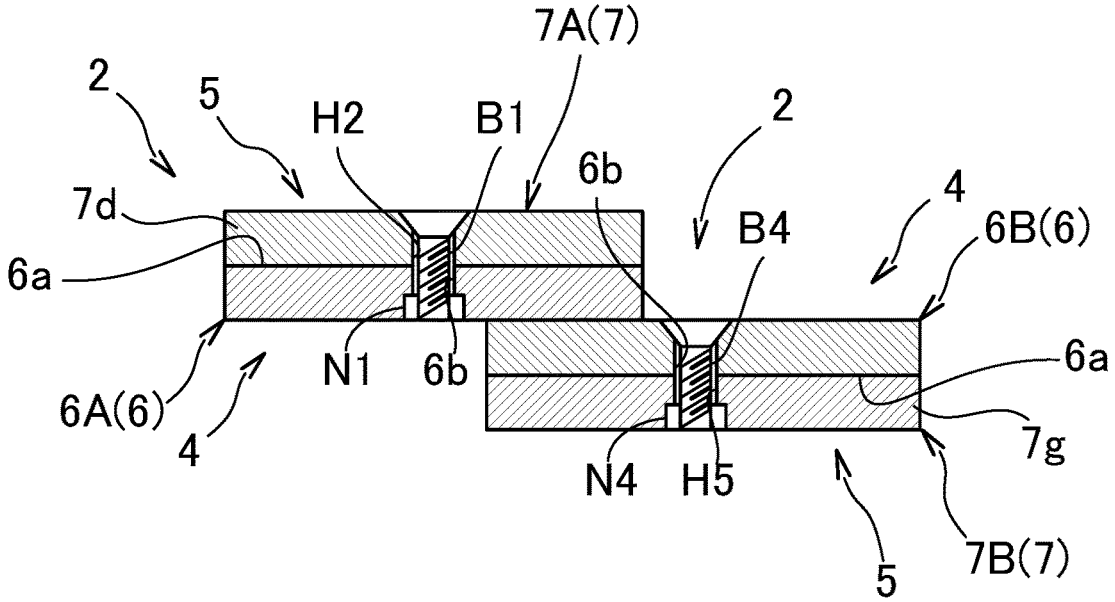
FIG. 8 is a cross-sectional view taken along the plane VIII-VIII indicated in FIG. 7.

As illustrated in FIG. 8, one screw insertion hole H2 is then formed at a center of the extension portion 7*d*. When the extension portion 7*d* is mounted on the attaching surface portion 6*a* of the cutout member 6A and then a screw B1 (fastening member) is inserted into the screw insertion hole H2 and the screw insertion hole 6*b* to sandwich the extension portion 7*d* and the cutout portion 6A by the screw B1 and a nut N1, the extension portion 7*d* is connected to the cutout member 6A. Thus, the extension portion 7*d* is fastened to the cutout member 6A by using the screw B1 positioned to extend along the axial center of the pivot 4*b*, allowing fine adjustment of an angle of the extension portion 7*b* around the screw B1 with respect to the cutout portion 6A when being fastened. Accordingly, a change of a fine angle between the middle portion 4 and the handle portion 5 in the one of the blade bodies 2 can be performed in accordance with preference of a user.

The second press-formed body 8A is positioned on the other end side of the pivot 4*b*. As shown in FIG. 2, the second press-formed body 8A includes a little finger engagement portion 8*a* that has a generally triangular shape as viewed in plan, a ring finger tip side ring 8*b* (second ring) into which a user's ring finger can be inserted, and a support portion 8*c* that is a portion for placing index and middle fingers on an outer peripheral edge of the support portion to operate, in turn from the base end of the blade body 2. The little finger engagement portion 8*a*, the ring finger tip side ring 8*b*, and the support portion 8*c* are shaped to correspond to the little finger engagement portion 7*a*, the ring finger base side ring 7*b*, and the support portion 7*c*, respectively.

The second press-formed body 8A, in contrast, lacks an extension portion 7*d* as included in the first press-formed body 7A and is spaced apart from the cutout member 6A (see FIG. 3).

The ring finger tip side ring 8*b* is positioned on a tip side of a ring finger with the ring finger being inserted for hairdressing.

An opening 80*a* having a shape corresponding to the opening 70*a* formed in the little finger engagement portion 7*a* is formed in the little finger engagement portion 8*a*. Openings 80*b*, 80*c* having shapes corresponding to the respective openings 70*b*, 70*c* formed in the support portion 7*c* are formed in the support portion 8*c*.

As illustrated in FIGS. 5 and 6, screw insertion holes H3 are formed at positions of the second press-formed body 8A corresponding to the respective screw insertion holes H1 of the first press-formed body 7A.

As illustrated in FIG. 1, a first resin material 9A (bridge) extending along the longitudinal direction of the blade body 2 and being in the shape of a generally square bar is provided between the first and second press-formed bodies 7A, 8A along an edge closer to the other of the blade bodies 2.

Thus, the first resin material 9A bridges the first and second press-formed bodies 7A, 8A and is provided to fill part of a space between the first and second press-formed bodies 7A, 8A.

A contact 9*a* extending toward the other of the blade bodies 2 and having a generally triangular shape as viewed from the front is provided at a midsection of the first resin material 9A. The contact 9*a* is integrally formed with the first resin material 9A when the first resin material 9A is formed by injection molding.

As illustrated in FIG. 5, a screw insertion hole 9*b* is formed at a position of the first resin material 9A corresponding to the screw insertion holes H1, H3. When a screw B2 is inserted in turn into the screw insertion holes H1, 9*b*, and H3 to sandwich the first press-formed body 7A, the first resin material 9A, and the second press-formed body 8A by the screw B2 and a nut N2, the first press-formed body 7A, the first resin material 9A, and the second press-formed body 8A thereby become integral.

On the other hand, as illustrated in FIG. 6, a cylindrical collar 11 (bridge) having a screw insertion hole 11*a* is provided between the screw insertion holes H1, H3 facing each other in an area of the first and second press-formed bodies 7A, 8A that does not have the first resin material 9A. When a screw B3 is inserted in turn into the screw insertion holes H1, 11*a*, and H3 to sandwich the first press-formed body 7A, the cylindrical collar 11, and the second press-formed body 8A by the screw B3 and a nut N3, the first press-formed body 7A, the cylindrical collar 11, and the second press-formed body 8A thereby become integral.

While the first resin material 9A, the screw B2, and the nut N2 are included in a size adjusting part 10*a* of the present disclosure, the cylindrical collar 11, the screw B3, and the nut N3 are included in a size adjusting part 10*b* of the present disclosure. The handle portion 5 of the one of the blade bodies 2 can have a varied size in a thickness direction by changing a size of the first resin material 9A and the cylindrical collar 11. Accordingly, the size of the handle portion 5 of the one of the blade bodies 2 in the thickness direction can be changed in accordance with preference of a user, enabling the hairdressing scissors 1 to have significant advantages for ease of use by the user.

The first press-formed body 7B is positioned on the other end side of the pivot 4*b*. As shown in FIG. 2, the first press-formed body 7B includes a thumb tip side ring 7*e* (first ring) into which a user's thumb can be inserted, a support portion 7*f* that has a generally triangular shape as viewed in plan, and an extension portion 7*g* extending from the support portion 7*f* toward the associated middle portion 4, in turn from the base end of the blade body 2. The thumb tip side ring 7*e* is shaped to curve and project laterally more than the support portion 7*f* and the extension portion 7*g*.

The thumb tip side ring 7*e* is positioned on a tip side of a thumb with the thumb being inserted for hairdressing.

An opening 70*d* generally triangular in shape is formed in the support portion 7*f*. Thus, the opening 70*d* having a characteristic shape is formed in an area of the first press-formed body 7B excluding the thumb tip side ring 7*e*.

As illustrated in FIGS. 5 and 6, four screw insertion holes H4 are formed in the first press-formed body 7B. Specifically, one of the four screw insertion holes H4 is formed in a portion of the thumb tip side ring 7*e* opposite the support portion 7*f*, two of the four screw insertion holes H4 are formed in a continuous portion between the thumb tip side ring 7*e* and the support portion 7*f*, and one of the four screw insertion holes H4 is formed in a continuous portion between the support portion 7*f* and the extension portion 7*g*.

As illustrated in FIG. 4, the extension portion 7*g* includes a portion of a middle portion 4 side of the extension portion 7*g* that can be mounted on an attaching surface portion 6*a* of a cutout member 6B. When the extension portion 7*g* is mounted on the attaching surface portion 6*a*, a surface of the extension portion 7*g* is flush with a surface of the cutout member 6B.

As illustrated in FIG. 2, the extension portion 7*g* includes an edge 7*j* of the middle portion 4 side of the extension portion 7*g* that is concave to gently curve for corresponding to a shape of a rising wall portion 6*c* of the attaching surface portion 6*a* of the cutout member 6B.

As illustrated in FIG. 8, one screw insertion hole H5 is then formed at a center of the extension portion 7*g*. When the extension portion 7*g* is mounted on the attaching surface portion 6*a* of the cutout member 6B and then a screw B4 (fastening member) is inserted into a screw insertion hole 6*b* formed in the attaching surface portion 6*a* and the screw insertion hole H5 to sandwich the cutout portion 6B and the extension portion 7*g* by the screw B4 and a nut N4, the extension portion 7*g* is connected to the cutout member 6B. Thus, the extension portion 7*g* is fastened to the cutout member 6B by using the screw B4 positioned to extend along the axial center of the pivot 4*b*, allowing fine adjustment of an angle of the extension portion 7*g* around the screw B4 with respect to the cutout portion 6B when being fastened. Accordingly, a change of a fine angle between the middle portion 4 and the handle portion 5 in the other of the blade bodies 2 can be performed in accordance with preference of a user.

The second press-formed body 8B is positioned on the one end side of the pivot 4*b*. As shown in FIG. 1, the second press-formed body 8B includes a thumb base side ring 8*e* (second ring) into which a user's thumb can be inserted, and a support portion 8*f* that has a generally triangular shape as viewed in plan, in turn from the base end of the blade body 2. The thumb base side ring 8*e* and the support portion 8*f* are shaped to correspond to the thumb tip side ring 7*e* and the support portion 7*f*, respectively.

The second press-formed body 8B, in contrast, lacks an extension portion 7*g* as included in the first press-formed body 7B and is spaced apart from the cutout member 6B (see FIG. 3).

The thumb base side ring 8*e* is positioned on a base side of a thumb with the thumb being inserted for hairdressing. The thumb base side ring 8*e* is formed to have a size D1 in a direction along the longitudinal direction of the blade body 2 larger than a size D2 of the thumb tip side ring 7*e* in the direction along the longitudinal direction of the blade body 2.

An opening 80*d* generally triangular in shape is formed in the support portion 8*f*. Thus, the opening 80*d* having a characteristic shape is formed in an area of the second press-formed body 8B excluding the thumb base side ring 8*e*.

As illustrated in FIGS. 5 and 6, screw insertion holes H6 are formed at positions of the second press-formed body 8B corresponding to the respective screw insertion holes H4 of the first press-formed body 7B.

As illustrated in FIG. 1, a second resin material 9B (bridge) extending along the longitudinal direction of the blade body 2 and being in the shape of a generally square bar is provided between the first and second press-formed bodies 7B, 8B along an edge closer to the one of the blade bodies 2.

Thus, the second resin material 9B bridges the first and second press-formed bodies 7B, 8B and is provided to fill part of a space between the first and second press-formed bodies 7B, 8B. When the handle portions 5 are brought closer to close the blade portions 3, the second resin material 9B comes in contact with the contact 9*a* to regulate subsequent rotation of the blade bodies 2.

As illustrated in FIG. 5, screw insertion holes 9*c* are formed at positions of the second resin material 9B corresponding to the screw insertion holes H4, H6. When a screw B5 is inserted in turn into the screw insertion holes H6, 9*c*, and H4 to sandwich the first press-formed body 7B, the second resin material 9B, and the second press-formed body 8B by the screw B5 and a nut N5, the first press-formed body 7B, the second resin material 9B, and the second press-formed body 8B thereby become integral.

On the other hand, as illustrated in FIG. 6, a cylindrical collar 12 (bridge) having a screw insertion hole 12*a* is provided between the screw insertion holes H4, H6 facing each other in an area of the first and second press-formed bodies 7B, 8B that does not have the second resin material 9B. When a screw B6 is inserted in turn into the screw insertion holes H6, 12*a*, and H4 to sandwich the first press-formed body 7B, the cylindrical collar 12, and the second press-formed body 8B by the screw B6 and a nut N6, the first press-formed body 7B, the cylindrical collar 12, and the second press-formed body 8B thereby become integral.

While the second resin material 9B, the screw B5, and the nut N5 are included in a size adjusting part 10*c* of the present disclosure, the cylindrical collar 12, the screw B6, and nut N6 are included in a size adjusting part 10*d* of the present disclosure. The handle portion 5 of the other of the blade bodies 2 can have a varied size in the thickness direction by changing a size of the second resin material 9B and the cylindrical collar 12. Accordingly, the size of the handle portion 5 of the other of the blade bodies 2 in the thickness direction can be changed in accordance with preference of a user, enabling the hairdressing scissors 1 to have significant advantages for ease of use by the user.

The first resin material 9A and the cylindrical collar 11 are then formed to have a size larger than the second resin material 9B and the cylindrical collar 12 in the thickness direction of the handle portion 5. Thus, when a user places index and middle fingers on the outer peripheral edges of the support portions 7*c*, 8*c*, the support portions 7*c*, 8*c* are spaced apart in a direction of finger extension to contact with the fingers. This allows the user to perform stable close and open operations of the hairdressing scissors 1 during hairdressing, enabling the hairdressing scissors 1 to have significant advantages for ease of use by the user.

According to the first embodiment of the present disclosure, when the hairdressing scissors 1 are assembled, a portion between the first and second press-formed bodies 7, 8 of each of the handle portions 5 except the first and second resin materials 9A, 9B and the cylindrical collars 11, 12 renders a space without structures. The scissors 1 are thus lightweight on the handle portion 5 side thereof and reduce a load required for the user to move the handle portions 5 during hairdressing.

Components forming front and back surfaces of the handle portion 5 are then formed from the metal plates. As a result, even when a mirror finish is applied to the surfaces of the handle portion 5, less labor is required as compared to commonly used hairdressing scissors 1 having handle portions 5 formed by casting. Thus, a workload of worker for manufacturing the scissors 1 can be reduced, enabling the hairdressing scissors 1 to be inexpensive.

While the extension portion 7*d* of the first press-formed body 7A is connected to the middle portion 4 of the one of the blade bodies 2 on the one end side of the pivot 4*b*, the extension portion 7*g* of the first press-formed body 7B is connected to the middle portion 4 of the other of the blade bodies 2 on the other end side of the pivot 4*b*. Moreover, both of the second press-formed bodies 8A, 8B are not connected to the respective middle portions 4. The hairdressing scissors 1 are thus configured to avoid a state where each of the second press-formed bodies 8A, 8B contacts the mating blade body 2 to make the hairdressing scissors 1 unable to close when the handle portions 5 of the assembled hairdressing scissors 1 are brought closer to each other.

The first and second press-formed bodies 7, 8 include a plurality of the openings 70*a* to 70*d*, 80*a* to 80*d* each having a varying shape, respectively. This allows each of the handle portions 5 to have an appearance as if formed by combining a plurality of frames, and thereby, design of the whole scissors 1 can be improved.

The thumb base side ring 8*e* is then formed to have a size larger than the facing thumb tip side ring 7*e*. When the user performs hairdressing, the user can easily rotate the thumb with respect to the blade body 2 within a range of the thumb base side ring 8*e* about the thumb tip side ring 7*e* as a rotation supporting point. The user thus can easily change a position of the scissors 1 in accordance with preference of the user during hairdressing. Particularly, in the first embodiment of the present disclosure, the thumb base side ring 8*e* is formed to have a size wider than the facing thumb tip side ring 7*e* in the direction along the longitudinal direction of the blade body 2. When the user swings the thumb along the longitudinal direction of the blade body 2 to change a position of a hand with respect to the scissors 1, the user can easily change a state of the scissors 1, enabling efficient hairdressing.

The first and second resin materials 9A, 9B are visible between the first and second press-formed bodies 7, 8 and thus add a change in the design of the handle portions 5. Accordingly, the design of the scissors 1 can be further improved.

The handle portions 5 then have mutually contact portions formed of a resin (contact 9*a* and second resin material 9B). When the handle portions 5 are brought closer to each other, impact of the contacting can be efficiently absorbed.

In the first embodiment of the present disclosure, the thumb base side ring 8*e* is formed to have the size larger than the facing thumb tip side ring 7*e*; however, the scissors 1 may be made such that the thumb tip side ring 7*e* is formed to have a size larger than the thumb base side ring 8*e*. The scissors 1 may be also formed such that the ring finger tip side ring 8*b* is formed to have a size larger than the facing ring finger base side ring 7*b*, and that the ring finger base side ring 7*b* is formed to have a size larger than the ring finger tip side ring 8*b*.

In the first embodiment of the present disclosure, the first resin material 9A is provided with the contact 9*a*; however, the second resin material 9B may be provided with a contact 9*a* extending toward the first resin material 9A.

In the first embodiment of the present disclosure, the contact 9*a* is integrally formed with a body portion of the first resin material 9A; however, the contact 9*a* may be separately formed from the body portion of the first resin material 9A and subsequently assembled.

In the first embodiment of the present disclosure, the first press-formed bodies 7A, 7B are connected with respect to the respective cutout members 6A, 6B by fastening by means of the respective screws B1, B4; however, the first press-formed bodies 7A, 7B are connected to the respective cutout members 6A, 6B by joining by means of adhesives and brazing.

In the first embodiment of the present disclosure, the first resin material 9A and the cylindrical collar 11 have the size larger than the second resin material 9B and the cylindrical collar 12 in the thickness direction of the handle portion 5; however, the first resin material 9A and the cylindrical collar 11 may have a size equal to, or smaller than the second resin material 9B and the cylindrical collar 12 in the thickness direction of the handle portion 5.

In the first embodiment of the present disclosure, the first and second press-formed bodies 7, 8 formed by press forming are included as part of the handle portion 5; however, the first and second press-formed bodies 7, 8 may be formed from a plate member machined from a metal plate.

Second Embodiment of Disclosure

Figure 9:
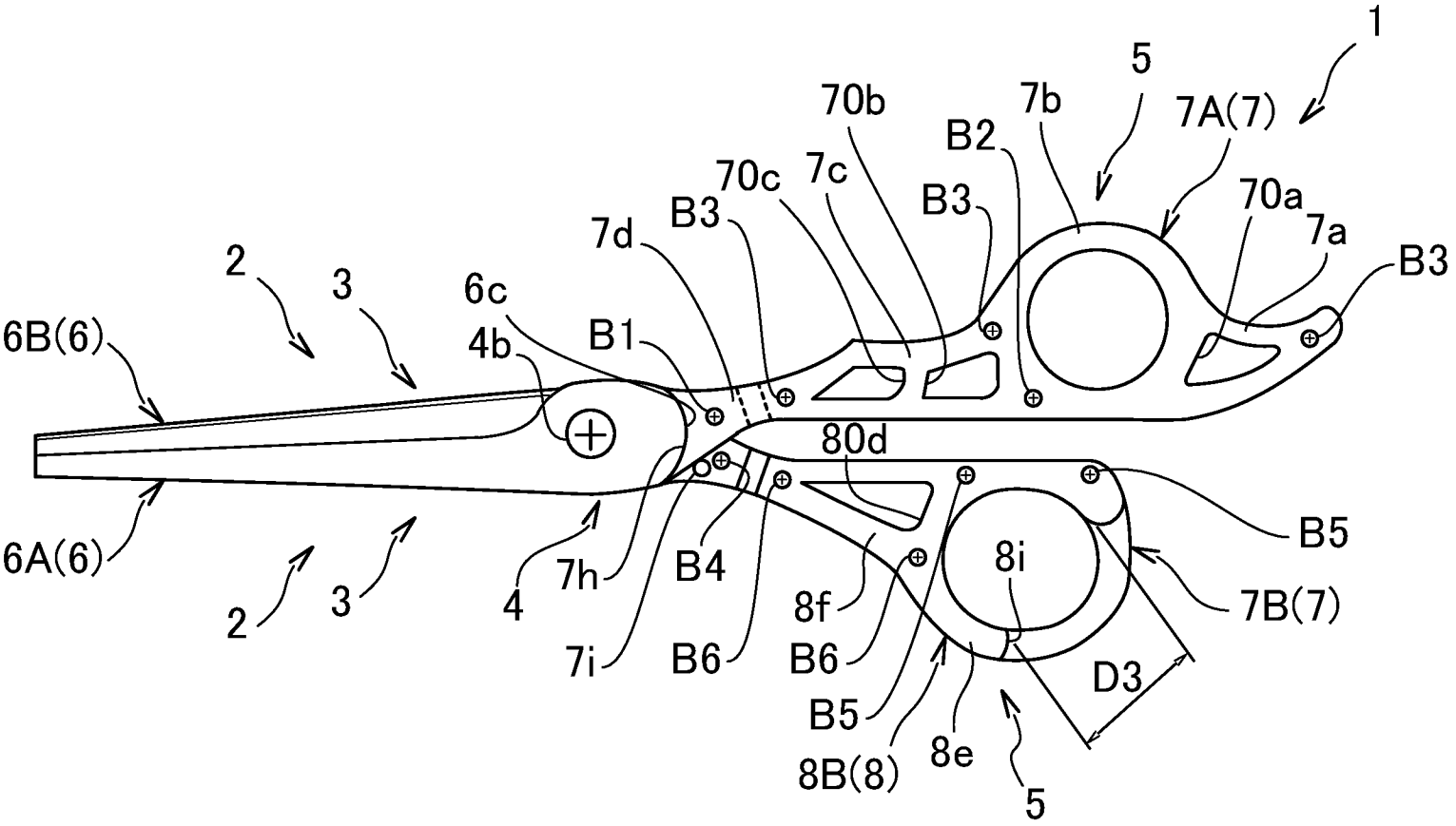
FIG. 9 is a view corresponding to FIG. 1, according to a second embodiment of the present disclosure.
Figure 10:
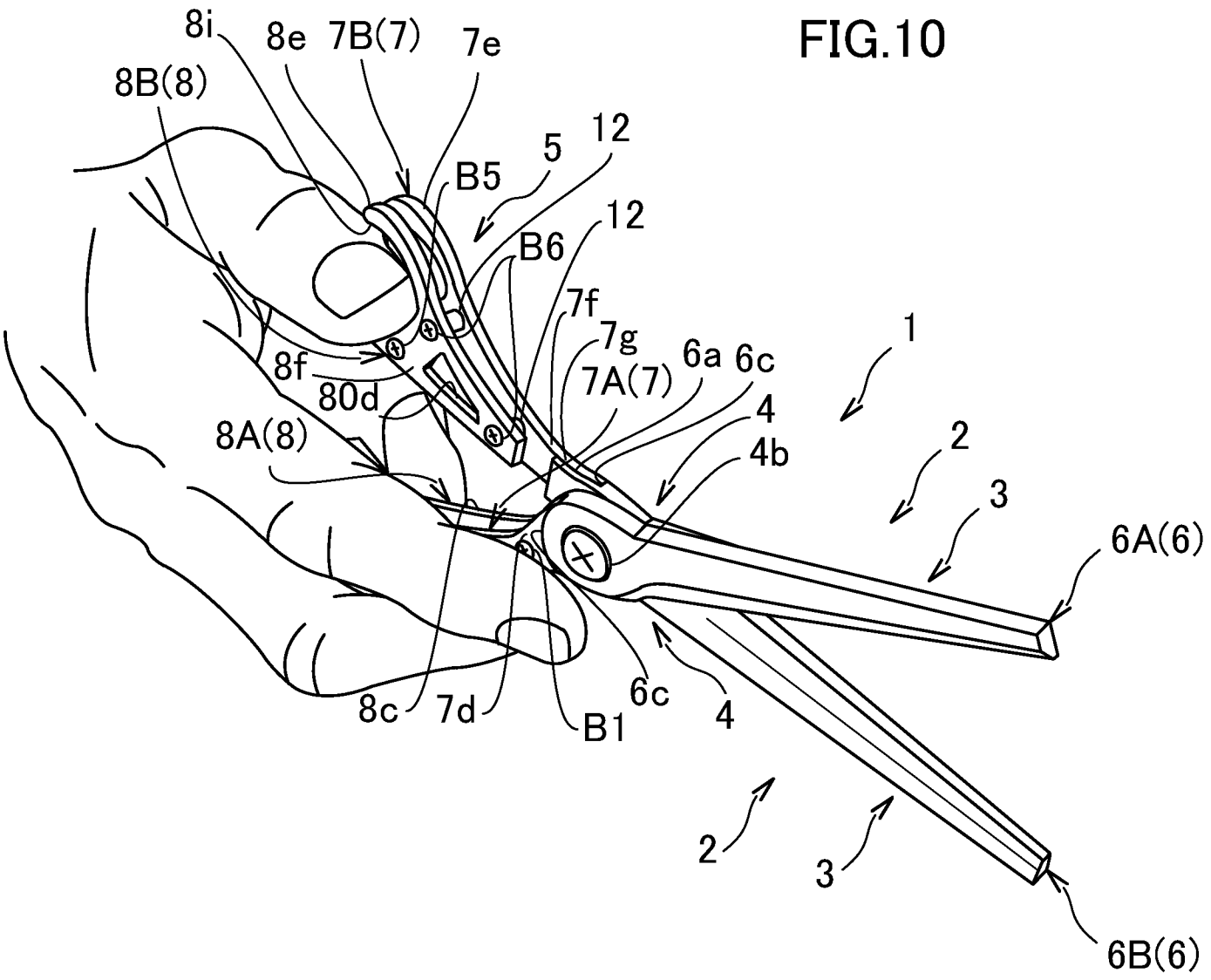
FIG. 10 is a perspective view illustrating a state where hairdressing scissors according to the second embodiment of the present disclosure are being used.

FIGS. 9 and 10 illustrate hairdressing scissors 1 according to a second embodiment of the present disclosure. The second embodiment differs from the first embodiment only in part of the structure of each of handle portions 5, while being the same as the first embodiment in connection with other aspects. Only aspects different from the first embodiment will be explained below.

In the second embodiment, first and second resin materials 9A, 9B are not provided between first and second press-formed bodies 7A, 8A and between first and second press-formed bodies 7B, 8B, respectively. The cylindrical collars 11, 12 bridge all corresponding screw insertion holes H1 and screw insertion holes H3 as well as corresponding screw insertion holes H4 and screw insertion holes H6.

A cutout section 8*i* causing inner and outer areas of a thumb base side ring 8*e* in communication with each other and having a width size D3 that corresponds to a width size of a thumb is formed in a portion of the thumb base side ring 8*e* of the second press-formed body 8B opposite the middle portion 4. As shown, for example, in FIG. 10, the thumb can be fit into the cutout section 8*i* when a user holds the scissors 1 in a state where the user orients an index finger toward tips of the scissors 1 to place the finger on the associated middle portion 4 of the scissors 1, and places the thumb to be angled with respect to the thumb tip side ring 7*e* and the thumb base side ring 8*e*. Accordingly, even when the user holds the scissors 1 in the particular state as described above, the user can firmly engage the thumb with the associated handle portion 5 without a load on the thumb so as to perform close and open operations of the scissors 1.

In addition, a pin 7*i* (projection) extending toward one of the blade bodies 2 side along the axial center of the pivot 4*b* is formed on an extension portion 7*g* of the second embodiment. The pin 7*i* is configured to contact an edge of an extension portion 7*d* to regulate subsequent rotation of the blade bodies 2 when the handle portions 5 are brought closer to close the blade portions 3. Thus, the rotation of the blade bodies 2 stops at a predetermined position when the handle portions 5 are brought closer to each other. This allows the scissors 1 to have required functions even with the scissors 1 having a structure as described in the first embodiment but including no first and second resin materials 9A, 9B between the first and second press-formed bodies 7, 8.

In the second embodiment of the present disclosure, the pin 7*i* is formed on the extension portion 7*g*; however, a pin 7*i* can be formed on the extension portion 7*d*, such that the pin 7*i* contacts an edge of the extension portion 7*g* to regulate subsequent rotation of the blade bodies 2 when the handle portions 5 are brought closer to close the blade portions 3.

Third Embodiment of Disclosure

Figure 11:
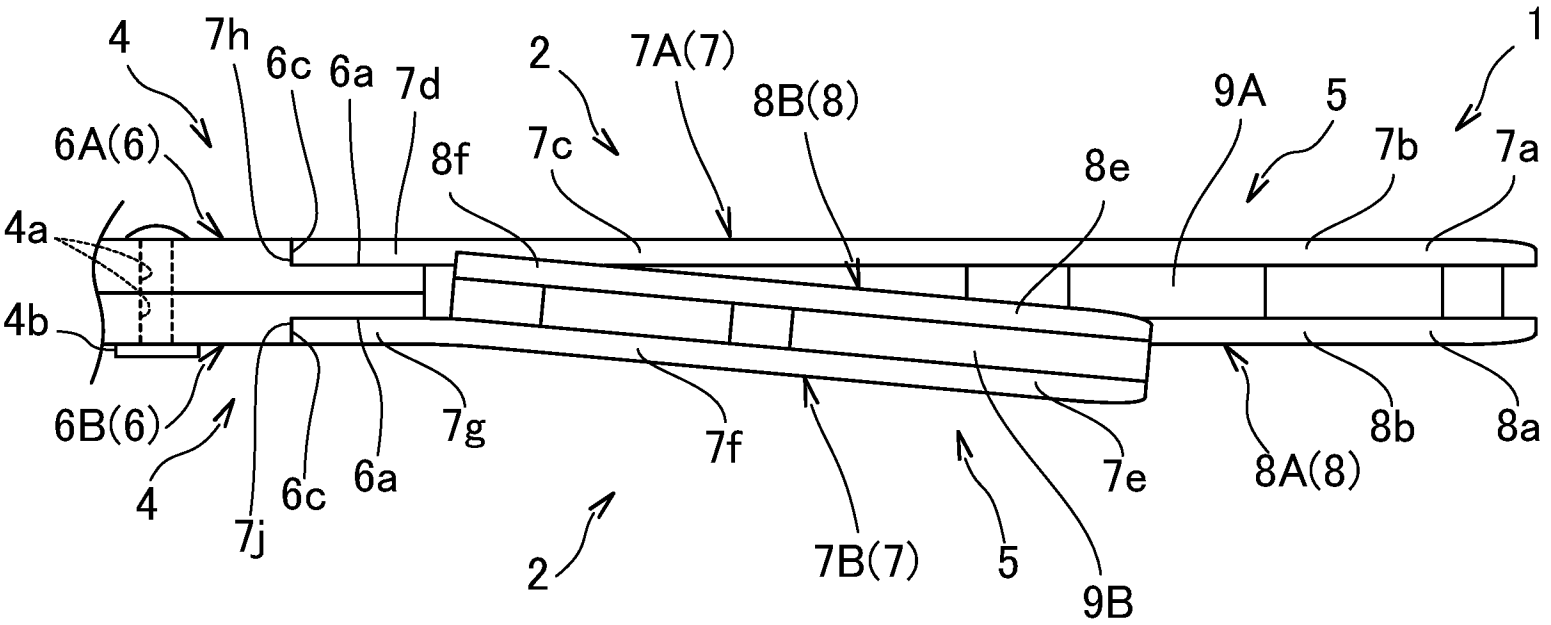
FIG. 11 is a view corresponding to FIG. 4, according to a third embodiment of the present disclosure.

FIG. 11 illustrates hairdressing scissors 1 according to a third embodiment of the present disclosure. The third embodiment differs from the first embodiment only in part of the structure of a first press-formed body 7B, while being the same as the first embodiment in connection with other aspects. Only aspects different from the first embodiment will be explained below.

In the third embodiment, the first press-formed body 7B includes an extension portion 7*g* bent in a direction away from a user's palm holding the scissors 1 to have a cross section that is an obtusely angled V-shape. Accordingly, a thumb will have an extension direction oriented parallel to a penetrating direction of a thumb tip side ring 7*e* and a thumb base side ring 8*e*, for example, when a user holds the scissors 1 in a state where the user orients an index finger toward tips of the scissors 1 to place the finger on the associated middle portion 4 of the scissors 1, and places the thumb to be angled with respect to the thumb tip side ring 7*e* and the thumb base side ring 8*e*. Thus, this enables less load applied from the thumb tip side ring 7*e* and the thumb base side ring 8*e* onto the thumb, and even when the user holds the scissors 1 in the particular state as described above, the user can firmly engage the thumb with the handle portion 5 to easily perform close and open operations of the scissors 1.

In the third embodiment of the present disclosure, the extension portion 7*g* is bent to have a V-shaped cross section; however, the present disclosure is not limited to this configuration. For example, an extension portion 7*g* may be formed from a metal plate made of a flexible material and the handle portion 5 is thereby flexed in a direction away from a user's palm when the user holds the scissors 1 so as to position an extension direction of a thumb to be parallel to a penetrating direction of a thumb tip side ring 7*e* and a thumb base side ring 8*e*.

Fourth Embodiment of Disclosure

Figure 12:
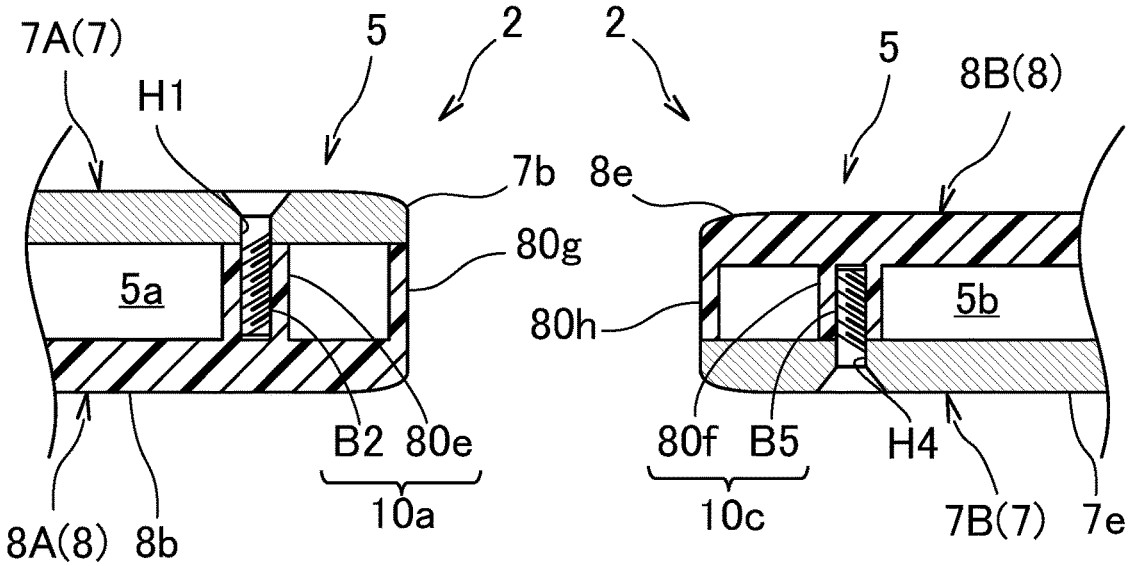
FIG. 12 is a view corresponding to FIG. 5, according to a fourth embodiment of the present disclosure.
Figure 13:
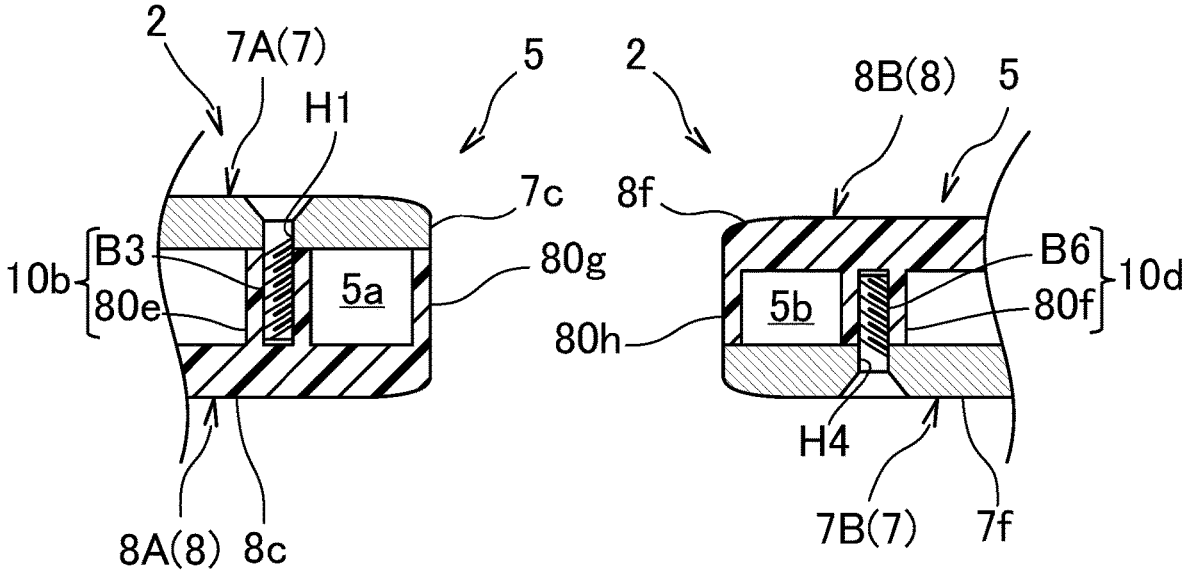
FIG. 13 is a view corresponding to FIG. 6, according to the fourth embodiment of the present disclosure.

FIGS. 12 and 13 illustrate hairdressing scissors 1 according to a fourth embodiment of the present disclosure. The fourth embodiment differs from the first embodiment only in part of the structure of handle portions 5, while being the same as the first embodiment in connection with other aspects. Only aspects different from the first embodiment will be explained below.

In the fourth embodiment, the second press-formed bodies 8A, 8B described in the first embodiment are replaced by respective second plate parts 8A, 8B formed from a resin member. The first and second resin materials 9A, 9B as described in the first embodiment are not provided.

In the fourth embodiment, the screw insertion holes H3, H6 as described in the first embodiment are not formed and bosses 80*e*, 80*f* protrude instead at the positions where the respective screw insertion holes H3, H6 are formed in the second press-formed bodies 8A, 8B.

Outer circumferential walls 80*g*, 80*h* extending toward outer peripheral edges of associated first plate parts 7A, 7B are formed at outer peripheral edges of the respective second plate parts 8A, 8B.

The second plate part 8A, the boss 80*e*, and the outer circumference wall 80*g* are integrally formed by injection molding.

The second plate part 8B, the boss 80*f*, and the outer circumference wall 80*h* are also integrally formed by injection molding.

Screws B2, B3 are then inserted into screw insertion holes H1 to fasten the screws B2, B3 into the bosses 80*e*, thereby causing the first and second plate parts 7A, 8A to be integral. A hollow portion 5*a* is thus formed by the first and second plate parts 7A, 8A and the circumferential wall 80*g* in one of the handle portions 5.

On the other hand, screws B5, B6 are inserted into screw insertion holes H4 to fasten the screws B5, B6 into the bosses 80*f*, thereby causing the first and second plate parts 7B, 8B to be integral. A hollow portion 5*b* is thus formed by the first and second plate parts 7B, 8B and the circumferential wall 80*h* in the other of the handle portions 5.

In the fourth embodiment, a size adjusting part 10*a* includes the boss 80*e* and the screw B2, a size adjusting part 10*b* includes the boss 80*e* and the screw B3, a size adjusting part 10*c* includes the boss 80*f* and the screw B5, and a size adjusting part 10*d* includes the boss 80*f* and the screw B6.

According to the fourth embodiment of the present disclosure, components forming back surfaces of the handle portions 5 are formed from the resin members. As a result, the surfaces of the handle portions 5 do not need a mirror finish and less labor is required for manufacturing as compared to commonly used hairdressing scissors having handle portions 5 formed by casting.

In the fourth embodiment of the present disclosure, the outer circumferential walls 80*g*, 80*h* are provided with the outer peripheral edges of the respective second plate parts 8A, 8B; however, providing the outer circumferential walls 80*g*, 80*h* is not necessarily essential.

In the fourth embodiment of the present disclosure, the second plate part 8A, the boss 80*e*, and the outer circumference wall 80*g* are integrally formed by injection molding and the second plate part 8B, the boss 80*f*, and the outer circumference wall 80*h* are integrally formed by injection molding; however, separately formed components may be connected by means of adhesives, etc., to be completed.

Fifth Embodiment of Disclosure

Figure 14:
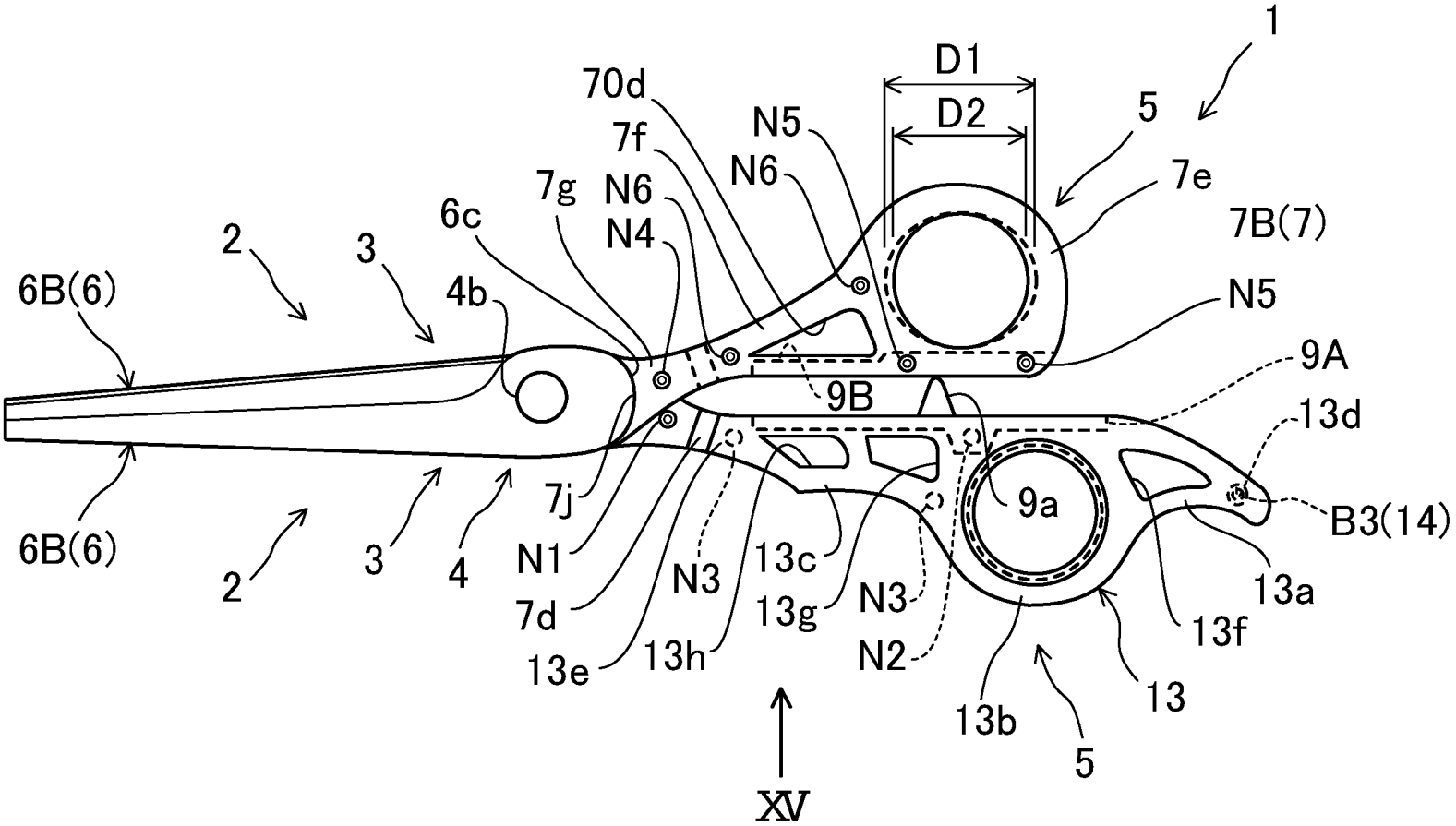
FIG. 14 is a view corresponding to FIG. 2, according to a fifth embodiment of the present disclosure.
Figure 15:
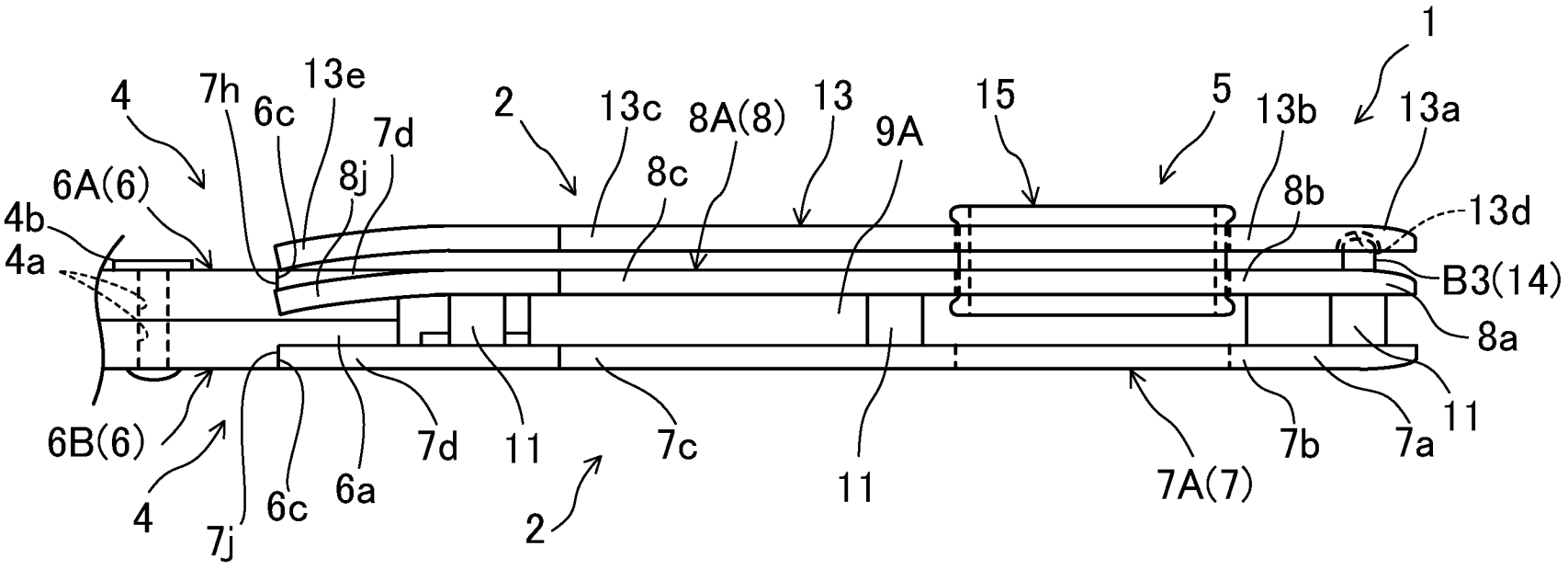
FIG. 15 is a fragmentary view taken in the direction of arrow XV indicated in FIG. 14.

FIGS. 14 and 15 illustrate hairdressing scissors 1 according to a fifth embodiment of the present disclosure. The fifth embodiment differs from the first embodiment only in part of the structure of each of handle portions 5, while being the same as the first embodiment in connection with other aspects. Only aspects different from the first embodiment will be explained below.

In the fifth embodiment, a first bend 8*j* that is bent toward a first press-formed body 7A is formed in a portion of a middle portion 4 side of a second press-formed body 8A of the handle portion 5 in one of the blade bodies 2.

In the fifth embodiment, the handle portion 5 in the one of the blade bodies 2 includes a third press-formed body 13 obtained by press forming of a plate-shaped aluminum alloy material.

The third press-formed body 13 has a flat shape and is disposed on a front surface side of the second press-formed body 8A at a predetermined spacing to extend parallel to the second press-formed body 8A. The spacing between the third press-formed body 13 and the second press-formed body 8A is formed to be smaller than a spacing between the second press-formed body 8A and the first press-formed body 7A.

The third press-formed body 13 includes a little finger engagement portion 13*a* that has a generally triangular shape as viewed in plan, an auxiliary ring 13*b* (third ring) into which a user's ring finger can be inserted, and a support portion 13*c* that is a portion for placing index and middle fingers on an outer peripheral edge of the support portion to operate, in turn from the base end of the blade body 2. The little finger engagement portion 13*a*, the auxiliary ring 13*b*, and the support portion 13*c* are shaped to correspond to the little finger engagement portion 8*a*, the ring finger tip side ring 8*b*, and the support portion 8*c*, respectively.

An opening 13*f* having a shape corresponding to the opening 80*a* formed in the little finger engagement portion 8*a* is formed in the little finger engagement portion 13*a*. Openings 13*g*, 13*h* having shapes corresponding to the respective openings 80*b*, 80*c* formed in the support portion 8*c* are formed in the support portion 13*c*.

A curved recess 13*d* that opens at a back surface side is formed in the little finger engagement portion 13*a* of the third press-formed body 13.

Then, a second bend 13*e* that is bent toward a second press-formed body 8A to correspond to the first bend 8*j* is formed in a portion of a middle portion 4 side of the support portion 13*c* of the third press-formed body 13.

A ring body 15 (connector) connecting the second and third press-formed bodies 8A, 13 is provided between the second and third press-formed bodies 8A, 13.

The ring body 15 is configured to allow a user's finger to be inserted and formed of a flexible rubber material.

The ring body 15 fits with both of the ring finger tip side ring 8*b* and the auxiliary ring 13*b* to thereby connect the second and third press-formed bodies 8A, 13.

In the fifth embodiment, the screw B3 for the little finger engagement portion 8*a* of the second press-formed body 8A extends through the little finger engagement portion 8*a* and has a tip portion extending from a surface of the little finger engagement portion 8*a*.

The portion of the tip of the screw B3 extending from the surface of the little finger engagement portion 8*a* forms a protrusion 14 of the present disclosure. The protrusion 14 loosely fits into the curved recess 13*d* of the third press-formed body 13.

According to the fifth embodiment of the present disclosure, when index and middle fingers are placed on the outer peripheral edge of the handle portion 5 for operating the hairdressing scissors 1, the index and middle fingers are supported by the three plate parts including the first, second, and third press-formed bodies 7A, 8A, 13 that are arranged side-by-side at the predetermined spacing, and firmly engage with each of the plate part along the thickness direction of the handle portion 5. Thus, the index and middle fingers are less likely to slip along the thickness direction of the handle portion 5 to ease the holding of the hairdressing scissors 1, enabling improved operability of the hairdressing scissors 1.

The hairdressing scissors 1 then has a weight distribution in which a handle portion 5 side is heavier than a blade portion 3 side. The center of gravity of the hairdressing scissors 1 is thus positioned on a user's hand side. This allows the blade portion 3 side to be lighter, resulting in further improved operability of the hairdressing scissors 1.

When the hairdressing scissors 1 are used, the fingers are inserted into the flexible ring body 15. An improved tactile property of the handle portion 5 is thus provided for the fingers during operation of the hairdressing scissors 1.

The ring body 15 is flexible to be easily connected to the ring finger tip side ring 8*b* and the auxiliary ring 13*b* and to also be able to establish an intimate contact with the ring finger tip side ring 8*b* and the auxiliary ring 13*b*.

In addition, the third press-formed body 13 freely moves in a tilting manner with respect to the second press-formed body 8A about the flexible ring body 15 as a supporting point. The third press-formed body 13 thus tilts to correspond to movement of a user's hand during operations of the hairdressing scissors 1, enabling the hairdressing scissors 1 to have excellent operability.

When the third press-formed body 13 is attached to the second press-formed body 8A using the ring body 15, the protrusion 14 is inserted to the curved recess 13*d*, so that the third press-formed body 13 is prevented from significantly rotating with respect to the second press-formed body 8A circumferentially about a centerline of the ring body 15 even when unexpected force circumferential about the centerline of the ring body 15 is applied to the third press-formed body 13.

Further, the first and second bends 8*j*, 13*e* are formed in the handle portion 5, so that when a user uses the hairdressing scissors, the fingers of the user are less likely to collide with end portions of a first press-formed body 7A side of the second and third press-formed bodies 8A, 13, thus enabling further improved operability of the hairdressing scissors 1.

In the fifth embodiment of the present disclosure, the third press-formed body 13 is provided at the front surface side of the second press-formed body 8A; however, the third press-formed body 13 may be provided at a front surface side of the first press-formed body 7A. In that case, the auxiliary ring 13*b* is formed at a position corresponding to the ring finger base side ring 7*b* of the first press-formed body 7A and the ring body 15 fits with the ring finger base side ring 7*b* and the auxiliary ring 13*b* to thereby connect the first and third press-formed bodies 7A, 13. The protrusion 14 is then formed on the front surface side of the first press-formed body 7A and loosely fits into the curved recess 13*d* of the third press-formed body 13.

In the fifth embodiment of the present disclosure, the third press-formed body 13 is formed from a metal plate, yet may be formed from a resin member.

In the fifth embodiment of the present disclosure, the second and third press-formed bodies 8A, 13 are connected by the ring body 15; however, the present disclosure is not limited to this configuration. For example, the second and third press-formed bodies 8A, 13 may be connected at multiple positions by using a screw, nut, and cylindrical collar, as described in the first embodiment.

The present disclosure is suitable for hairdressing scissors for use in hairdressing.

What is claimed is:

1. Hairdressing scissors, comprising: a pair of blade bodies each including a blade portion, a middle portion, and a handle portion; and a pivot inserted into axial support holes each formed in the middle portion of the respective blade bodies and rotatably connecting the blade bodies to each other to have the handle portions closer to and away from each other to thereby close and open the blade portions, wherein the handle portion includes: first and second plate parts formed from a flat metal plate or resin member and facing each other to be spaced apart at a predetermined spacing along an axial center of the pivot, and extending parallel to each other along a longitudinal direction of the blade body; and one or more bridges configured to bridge the first and second plate parts such that the predetermined spacing is formed between the first plate part and second plate part, the first plate part includes an extension portion extending toward an associated middle portion further than the second plate part to be connected to the associated middle portion and the second plate part is spaced apart from the associated middle portion, the first and second plate parts of one of the handle portions are positioned on one direction side and the other direction side along the axial center of the pivot, respectively, and the first and second plate parts of the other of the handle portions are positioned on the other direction side and the one direction side along the axial center of the pivot, respectively.

2. The hairdressing scissors according to claim 1, wherein the first plate part includes a first ring through which a user's finger can be inserted, the second plate part includes, at a position of the second plate part facing the first ring, a second ring through which a user's finger can be inserted, and a plurality of openings each having a varying shape are formed in areas of the first plate part excluding the first ring and of the second plate part excluding the second ring.

3. The hairdressing scissors according to claim 2, wherein one of the facing first and second rings located on a side from which a thumb is inserted for hairdressing, includes, in a portion thereof opposite to the middle portion, a cutout section that is cut out such that inner and outer areas of the ring located on the side from which the thumb is inserted are in communication with each other, the cutout section configured such that the thumb is insertable.

4. The hairdressing scissors according to claim 2, wherein one of the first and second rings facing each other is formed to have a size larger than the other of the first and second rings facing each other.

5. The hairdressing scissors according to claim 4, wherein one of the first and second rings facing each other is formed to have a size wider than the other of the first and second rings facing each other in a direction along the longitudinal direction of the blade body.

6. The hairdressing scissors according to claim 1, wherein one of the extension portions is provided in a handle portion associated with a thumb during hairdressing and bent in a direction away from a user's palm holding the scissors to have a cross-section that is an obtusely angled V-shape.

7. The hairdressing scissors according to claim 1, wherein at least one of the bridges is a resin material filling part of a space between the first and second plate parts.

8. The hairdressing scissors according to claim 7, wherein the resin material includes a pair of resin materials provided along edges of the respective handle portions on sides of the handle portions that come closer to each other, and one of the resin materials includes a contact extending toward the other of the resin materials and configured to come in contact with the other of the resin materials to regulate subsequent rotation of the blade bodies when the handle portions are brought closer to close the blade portions.

9. The hairdressing scissors according to claim 1, wherein one of the middle portions includes on a handle portion side thereof a projection extending along the axial center of the pivot and configured to contact an edge of the handle portion side of the other of the middle portions to regulate subsequent rotation of the blade bodies when the handle portions are brought closer to close the blade portions.

10. The hairdressing scissors according to claim 1, wherein the extension portion is fastened to the associated middle portion by using a fastening member positioned to extend along the axial center of the pivot.

11. The hairdressing scissors according to claim 1, wherein at least one of the bridges includes a size adjusting part configured to be able to change a size of the associated handle portion along a direction of the axial center of the pivot.

12. The hairdressing scissors according to claim 1, wherein one of the handle portions corresponds with a thumb of a user during hairdressing, and all of the bridges in the other of the handle portions are formed to have a size larger than that of all of the bridges in the one of the handle portions along the direction of the axial center of the pivot.

13. The hairdressing scissors according to claim 2, wherein the handle portion includes a third plate part formed from a flat metal plate or resin member and disposed on a front surface side of the first or second plate part at a predetermined spacing to extend parallel to the associated first or second plate part; and one or more connectors configured to connect the first and third plate parts or the second and third plate parts.

14. The hairdressing scissors according to claim 13, wherein the third plate part includes, at a position corresponding to the first or second ring, a third ring through which a user's finger can be inserted, and the connector is a flexible ring body configured to allow a user's finger to be inserted and capable of fitting with the first and third rings or the second and third rings.

15. The hairdressing scissors according to claim 13, wherein the third plate part includes a curved recess that opens at a back surface side, and the first or second plate part includes, at a position corresponding to the curved recess, a protrusion capable of fitting loosely into the curved recess.

16. The hairdressing scissors according to claim 1, wherein the second plate part includes on a middle portion side thereof a bend that is bent toward the first plate part.

* * * * *